United States Patent [19]

Ben-Porat

[11] 4,096,552

[45] Jun. 20, 1978

[54] ELECTRIC JEWELS

[76] Inventor: Josef Ben-Porat, 3014 Brighton 8th St., Brooklyn, N.Y. 11235

[21] Appl. No.: 636,928

[22] Filed: Dec. 2, 1975

[51] Int. Cl.[2] ..... F21V 33/00

[52] U.S. Cl. ..... 362/104; 362/106; 362/190; 362/293

[58] Field of Search ..... 240/10 R, 10 T, 10.1, 240/6.4 R, 6.4 W, 23, 24, 11.2 R, 16, 49, 46.59, 48; 362/103–109, 35, 261, 262, 272, 250, 190, 293

[56] References Cited

U.S. PATENT DOCUMENTS

| | | | |
|---|---|---|---|
| 2,092,577 | 9/1937 | Hornung | 35/9 R |
| 2,353,082 | 7/1944 | Roedding et al. | 362/250 |
| 2,815,439 | 12/1957 | Plubell | 40/540 |
| 2,854,563 | 9/1958 | Catching | 362/104 |
| 3,233,090 | 2/1966 | Wagner | 40/414 |
| 3,805,047 | 4/1974 | Dockstader | 362/104 |
| 3,836,759 | 9/1974 | Silverman | 362/103 |
| 3,984,674 | 10/1976 | Guetta | 362/104 X |

*Primary Examiner*—Richard A. Wintercorn

[57] ABSTRACT

A new article of jewelry such as a pendant with a necklace for being worn around a person's neck, the pendant including an ornamental case containing a dry cell battery and switch in circuit with one or more incandescent lamps each with its own blinker circuit breaker, the lamps being behind variously colored lens on a front side of the case so that when the switch is closed various colored lights are intermittently flashed producing a pyschodelic effect.

1 Claim, 9 Drawing Figures

FLASHERS

ELECTRIC JEWELS

This invention relates to jewelry.

A principal object of the present invention is to provide jewelry that is self illuminated, and produces intermitant flashes of different colored lights so to produce a psychodelic effect.

Another object is to provide electric jewels which would particularly appeal to modern young people who are unconventional in their tastes and who like to wear original or bizarre ornamentations.

Other objects are to provide electric jewels which is simple in design, inexpensive to manufacture, rugged in construction, easy to use and efficient in operation.

These and other objects will be readily evident upon a study of the following specification and the accompany drawing wherein:

FIG. 1 is a perspective view showing one design of the invention being worn around a person's neck.

FIG. 1*a* is an electric circuit thereof.

Figures 1, 1A, 2, 3, 4, 5, 6, 7, 8:
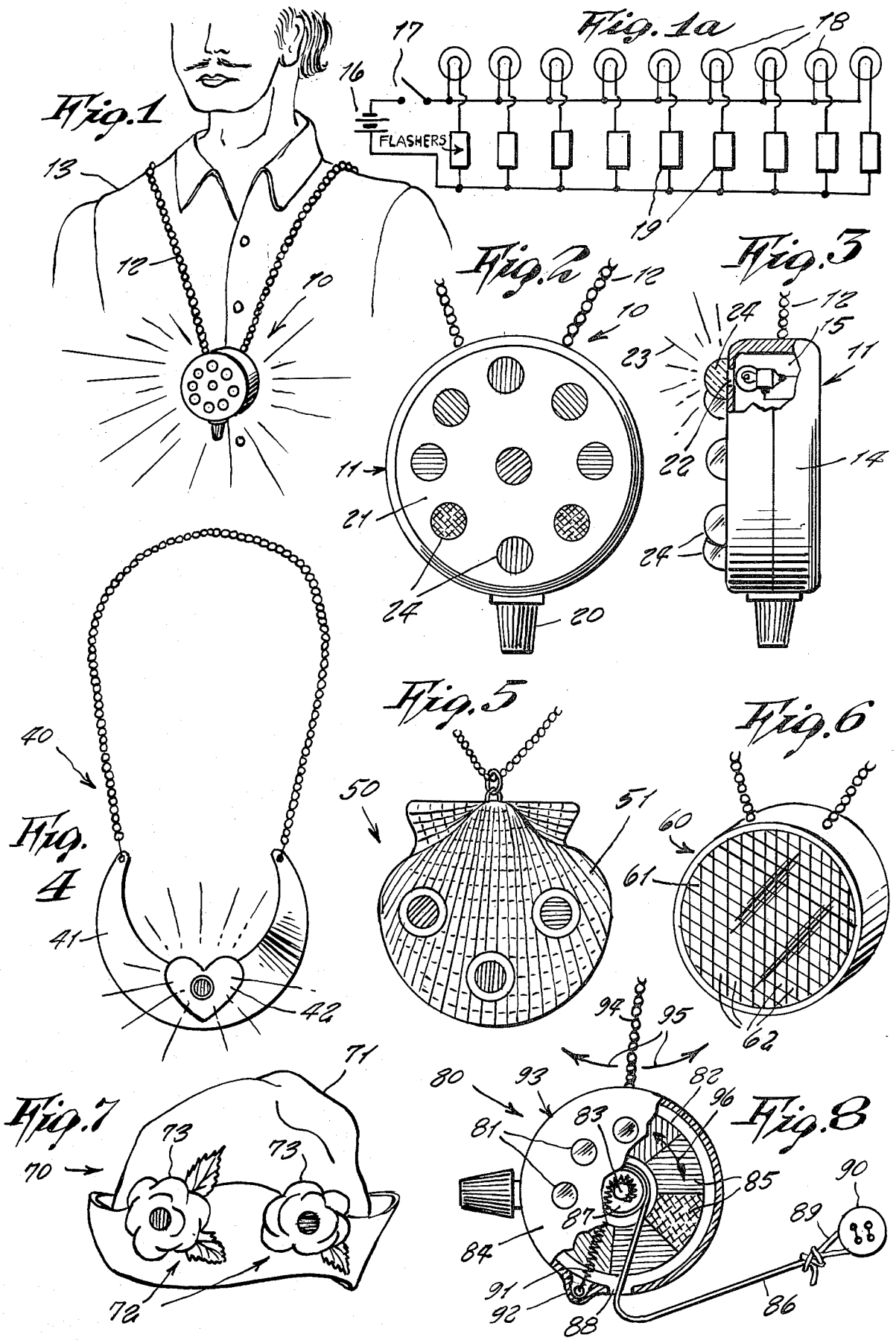
FIG. 2 is a front view of the device of FIG. 1.
FIG. 3 is a side view thereof shown partly in cross section.
FIGS. 4, 5 and 6 show modified designs of the invention for being worn around a neck.
FIG. 7 shows another modified design of the invention applied to a hat or cap.

FIG. 8 is a modified design of the invention in which a rotatable wheel is located between the lens and the lamps, the wheel having translucent different colored sections, the lens being of clear glass the wheel being rotatable by a string attached to a shirt button as the entire device sways on its neck chain, a return spring returning the wheel rotation in opposite direction, the device thus producing different colors of lights at each one of the lens.

Referring now to the drawing in greater detail, and more particularly to FIGS. 1 through 3 thereof at this time, the reference numeral 10 represents an electric jewel according to the present invention wherein there is a pendant 11 suspended on a necklace 12 for being worn around the neck of a person 13. The necklace and pendant may be made in any attractive ornamentation and of any desired material.

The pendant 11 consists of a case 14 within an interior 15 of which there are contained a dry cell miniature battery 16 and switch 17 which are in an electric circuit with a set of small electric lamps 18, each lamp either incorporating in its construction a blinker circuit breaker 19 or else being in series with its own separate circuit breaker unit. The switch has a switch knob or push button 20 extending outwardly of the case so that it can be manually operated. The blinker (or flasher) units 19 are of well known conventional construction which periodically cause the lamp circuit to be broken causing a blinking effect.

The case has a front side 21 having openings 22 therethrough so that light rays 23 from each lamp can shine outwardly therethrough. A lens 24 is mounted over each opening 22, each lens being of a different color.

In a particular example illustrated in FIGS. 1 to 3 the ornamentation of the pendant is that of a clock in which a circle of lens on a front side give the appearance of numerals around a clock face, and a central lens gives the illusion or representation of a pivot about which clock hands turn.

In operative use, it is now evident that the lamps will intermitantly produce flashing lights each in a different color.

In FIG. 4, an electric jewel 40 includes in its design a moon crescent 41, a heart 42 and a single lamp. The switch knob or button is on a rear.

In FIG. 5, the electric lamp 50 has a case in the shape of a sea shell 51.

In FIG. 6, the electric lamp 60 has a front translucent plastic plate 61 that is molded into small prisms or lens 62 through which light rays pass.

In FIG. 7, an electric jewel 70 includes a hat 71 for being worn on a person's head, the hat having decorative floral designs 72 having a lamp lens in center of each flower blossom 73.

The electrical apparatus (not shown) required to cause intermittant flashing of the lamps in the floral designs is mounted on the inside of the hat.

In FIG. 8, a modified design of electric jewel 80 is the same as electric jewel 10 except that the lens 81 thereof are colorless, and there is inside the case a circular disk 82 rotatable about a center shaft 83. The disk is located between the front wall 84 of the lamps 18 so to intercept the light rays from the lamps to the lens; the disk being of transparent plastic made into sectors 85 each of a different color. A string 86 at its one end is wound up on a hub 87 of the disc and the other end of the string extends outwardly of the case through a periphery opening 88 so that the terminal looped outer end 89 thereof can be hooked on a shirt button 90. A tension coil spring 91 secured at one end to the case periphery wall 92 is wound up at its other end and fastened to the hub 87, the spring being wound in an opposite direction to the direction of the string on the hub so that the spring serves as a return, rewind spring. The pendant 93 thus produced is suspended from a single chain 94 connected to a necklace.

In operative use, when worn, the pendant sways from side to side as a person walks or moves, as indicated by double headed arrow 95. The return spring normally maintains the string to be fully wound up on the hub, but as the pendant sways, tension on the string anchored to the button causes the disk to rotate against the pull of the spring so that as the pendant sways, the string and spring alternately cause the disk to rotate back and forth as indicated by double headed arrow 96. When the lamps are on, this causes different colors of light rays to appear at each lens.

Thus different forms of the invention are presented.

While various changes may be made in the detail construction, it is understood that such changes will be within the spirit and scope of the present invention as is defined by the appended claims.

What is claimed is:

1. An ornament with a flashing light adapted to be worn by a person comprising a case having a front wall with apertures therethrough wherein over each aperture a colored lens is mounted externally on said wall, in combination a lamp provided with a flasher unit mounted internally in said case in alignment with said lamp, including a battery and a switch in said case electrically connected with the lamp and a flasher unit, including external means on said case for actuating the switch to cause emission of flashing light through said lens, including means for mounting the ornament on a person, wherein the ornament is a cylindrical pendant with a circumferented side wall and the first said means comprises a push button mounted on said side wall and the second said means comprises a necklace secured to the case, or wherein the second said means comprises a hat with the case mounted on said hat, including a plurality of similar spaced lamps, apertures and lamps with flasher units combined in an electrical circuit within the case, in combination with a movable light transmitting disc mounted in said case between said apertures and said lamps, said disc having sectors of different colors, including means secured to the disc and extending externally through the case for moving the disc in a desired manner.

* * * * *